United States Patent [19]

Hermle

[11] 4,348,568

[45] * Sep. 7, 1982

[54] SWITCHING MECHANISM

[76] Inventor: Eduard Hermle, Kirchstr. 20, D 7303 Neuhausen a.d.F., Fed. Rep. of Germany

[ * ] Notice: The portion of the term of this patent subsequent to Dec. 9, 1997, has been disclaimed.

[21] Appl. No.: 88,060

[22] Filed: Oct. 24, 1979

[30] Foreign Application Priority Data

Oct. 25, 1978 [DE] Fed. Rep. of Germany ..... 2846369

[51] Int. Cl.[3] ..... H01H 3/42

[52] U.S. Cl. ..... 200/153 LB; 200/38 B; 74/568 T

[58] Field of Search ..... 74/568 R, 568 T; 200/38 B, 153 LB

[56] References Cited

U.S. PATENT DOCUMENTS

| | | | |
|---|---|---|---|
| 2,545,719 | 3/1951 | Wedeberg | 74/568 T |
| 2,564,335 | 8/1951 | Lake | 74/568 R |
| 2,839,948 | 6/1958 | Paul | 74/568 R |
| 2,864,264 | 12/1958 | Rass | 74/568 R |
| 3,221,117 | 11/1965 | Simmons | 74/568 R |
| 3,626,130 | 9/1970 | Siegal | 200/153 LB |
| 3,839,925 | 10/1974 | Ficken et al. | 74/568 R |
| 4,238,654 | 12/1980 | Hermle | 200/153 LB |

FOREIGN PATENT DOCUMENTS 7321672 9/1973 Fed. Rep. of Germany .

*Primary Examiner*—John W. Shepperd
*Attorney, Agent, or Firm*—Spencer & Kaye

[57] ABSTRACT

A switching mechanism has disc cams arranged on a shaft for actuating switches positioned beside the shaft. The disc cams are secured in a particular angular position in conjunction with an annular plastically deformable washer which has an unround aperture seated on a corresponding unround portion of the shaft and thereby locked to the shaft. The disc cam and the element are locked together by bending a region of the washer into a recess on the disc cam.

9 Claims, 6 Drawing Figures

SWITCHING MECHANISM

CROSS-REFERENCE TO RELATED APPLICATION

Application Ser. No. 71,239 by Eduard Hermle, now U.S. Pat. No. 4,238,654 issued Dec. 9, 1980, pertains to related subject matter.

The invention relates to a switching mechanism with a rotatable switch spindle which supports a plurality of disc cams for the actuation of switches disposed alongside the switch spindle, which said disc cams are rotatably and lockably retained on the switch spindle.

Switching mechanisms of this kind are widely used, for example for controlling presses in which each stroke must be individually triggered by an operating person, so that accident prevention becomes highly significant. Such accident prevention can be ensured only if the substantial and frequent accelerations and decelerations, which are a particular feature of single-stroking controls, do not cause shifting of the disc cams associated with the switching mechanism, i.e. if such cams do not rotate in relation to the switch spindle after they have been set.

Disc cams of most conventional switching mechanisms of the kind described hereinbefore are secured only by non positive means. Support bushes with a quadrilateral aperture are disposed on a quadrilateral region of the switching spindle so that they are positively prevented from rotating on the said switching spindle and two disc cams are slid on each of the support bushes and can be rotated thereon for the purpose of adjustment in a known switching mechanism, for example as disclosed by the German Gebrauchsmuster 73 21 672. The last mentioned support bush is provided with a flange and a boss adjoining the same and having external screw threading and a flat. To prevent rotation of the disc cams, adjusted in accordance with the desired switching points, the said cams are clamped by means of a ring nut, screw mounted onto the support bush boss, namely between the ring nut and the support bush flange, i.e. rotation is prevented merely by non positive means. A pressure transmitting collar, the aperture of which corresponds to the cross section of the support bush boss in the region of the flat, to prevent the rotation of the pressure transmission collar when the ring nut is tightened, is disposed between the said ring nut and the disc cam adjacent thereto to prevent rotation of the adjusted disc cams when the ring nut is tightened. Furthermore, a corrugated spring washer is inserted between the two disc cams which are retained by a support bush and said corrugated spring washer retains the disc cams in their previous positions, even when the ring nuts are slackened, so that the said disc cams do not inadvertently rotate on the disc spindle.

Practical experience has shown that in switching mechanisms with disc cams which are prevented from rotation merely by such non positive means it is not absolutely certain that under the effect of accelerations and decelerations in operation the disc cams do not rotate relative to the switch spindle, a feature which could lead to accidents if the disc cams concerned control a switch which is responsible for safety. Consideration must be given to another feature in this connection: not all switching positions of such a switching mechanism control functions on which accident prevention depends; as a rule it is only the aforementioned critical switching positions which are adjusted by the supply of the press while other switching positions are adjusted by the operator. It is therefore also not possible for the casing of a switching mechanism to be simply sealed, since the operator must have access to some of the switching positions.

A step by which after adjustment of the disc cams a continuous bore is provided in the disc cams and into the flange of the associated support bush and a stressing pin is driven into the said bore, has already been adopted to prevent rotation of disc cams relative to the switch spindle after such cams have been set. Since disc cams can be adjusted only when the switch spindle is installed in the switching mechanism casing, this not only means that the bore can be drilled only at an angle from above, i.e. not parallel with the switch spindle axis, but swarf is produced within the switching mechanism casing and such swarf cannot be completely removed so that the operational reliability of the switching mechanism itself is impaired. Furthermore, it is obvious that this method of preventing rotation is exceptionally awkward.

The prior art already discloses a switching mechanism of the initially mentioned kind which is provided with a rotation prevention device for at least one disc cam comprising as a first part the said disc cam and as a second part an element disposed adjacent to the disc cam on the switch spindle and prevented from rotating thereon by positive means, one part having a plastically deformable region which can be bent into a gap or recess of the second part for the purpose of preventing rotation of the disc cam by positive engagement means. To this end annular webs, extending in the axial direction are secured on the disc cams and can be plastically deformed and adjacent to each disc cam there is disposed a collar, prevented by positive engagement means from rotating relative to the switch spindle and having on its circumference a series of recesses so that at least one region of the plastically deformable annular web of each disc cam can be pressed into one of the recesses of the annular part associated with the said disc cam. Finally, one ring nut and one abutment are provided for clamping the disc cams between them so that frictional engagement additionally prevents unintentional rotation of said disc cams.

It is the object of the invention to further simplify the switching mechanism already proposed and this can be achieved in accordance with the invention with a switching mechanism with a rotatable switch spindle supporting a plurality of disc cams for the actuation of switches disposed alongside the switch spindle, which said disc cams are rotatably and lockably retained on the switch spindle, and with a rotation-preventing device for at least one disc cam comprising as a first part the said disc cam and as a second part an element disposed adjacent to the disc cam on the switch spindle and prevented from rotating thereon by positive engagement means, one of said parts having a plastically deformable region which can be bent into a gap or recess of the second part to prevent rotation of the disc cam by positive engagement means, characterized in that the second part of the rotation-preventing device is constructed as an annular, plastically deformable washer with a non circular aperture which is directly disposed in non rotational manner on a switch spindle region of non circular cross section or in a like region of a bush which extends through the disc cam and is disposed in non rotational manner on the switch spindle.

Washers, embodied as simple blank sheet metal components, can therefore be used in the construction according to the invention as plastically deformable parts the edge regions of which can be bent into recesses provided on the disc cams. Standardized and therefore particularly inexpensive components are used as the second part of the rotation prevention device in one preferred embodiment of the switching mechanism according to the invention, namely plastically deformable washers in which the edge of the aperture is provided with a tab, bent out of the plane of the washer to bear against a flat of the switch spindle or bush. It is also possible to construct the plastically deformable washer so that the edge of its aperture is provided with a tab which projects in the radial direction for engagement with a groove or to provide a recess for the engagement with a shaft key disposed on the switch spindle or bush; washers of this kind can of course also be produced exceptionally cheaply.

As already mentioned, some switching positions of the switching mechanisms described herein are provided for controlling functions which govern the prevention of accidents in a machine tool, for example a press, while other switching positions control functions whose performance is less critical; the disc cams of the switching positions which guarantee freedom from accidents are set only once by the manufacturer of the machines while the disc cams associated with the other switching positions must be frequently changed by the operator of the machine. A particularly advantageous embodiment of the switching mechanism according to the invention makes allowance for these circumstances and comprises at least one pair of disc cams of the first kind for operating a switch that performs a safety function and at least one pair of disc cams of the second kind for operating a second switch and the disc cams of the second kind as well as the plastically deformable washers associated therewith can be clamped in the axial direction between a nut and an abutment by means of the said nut so that the disc cams are additionally prevented from rotation by frictional engagement while the disc cams of the first kind are prevented from rotation at least substantially only by means of the plastically deformable washers associated therewith. For disc cams of the first kind it is therefore possible to dispense with prevention of rotation by clamping in the axial direction, which is costly in both manufacture and assembly, and a simple annular groove can be provided, for example on the switch spindle or on the bush which supports the disc cams and a likewise simple circlip or the like can be inserted in said annular groove.

Other features, advantages and details of the invention are disclosed in the accompanying claims and/or the description hereinbelow and the annexed drawing of three preferred embodiments of the switching mechanism according to the invention:

The annexed drawings show parts of switching mechanisms fully described and illustrated in, for example, the German Gebrauchsmusterschrift 73 21 672, so that it is not necessary in the context to illustrate and describe components such as the switching mechanism casing or the switches which are actuated by the switch spindle of the switching mechanism.

Figure 1:
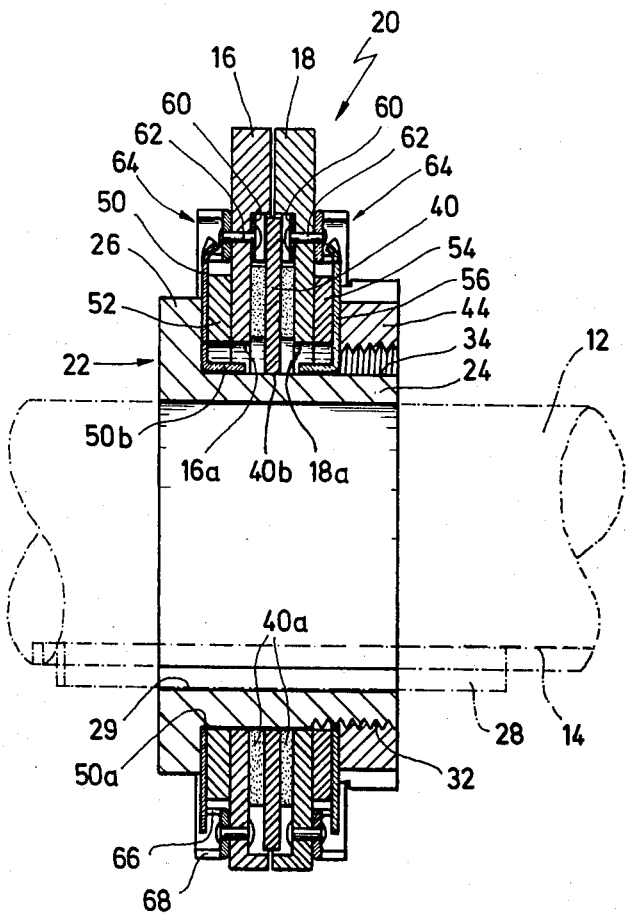
FIG. 1 is a sectional view of part of a switch spindle of the first embodiment with a unit comprising two disc cams for the operation of one switching position of the switching mechanism.
Figure 2:
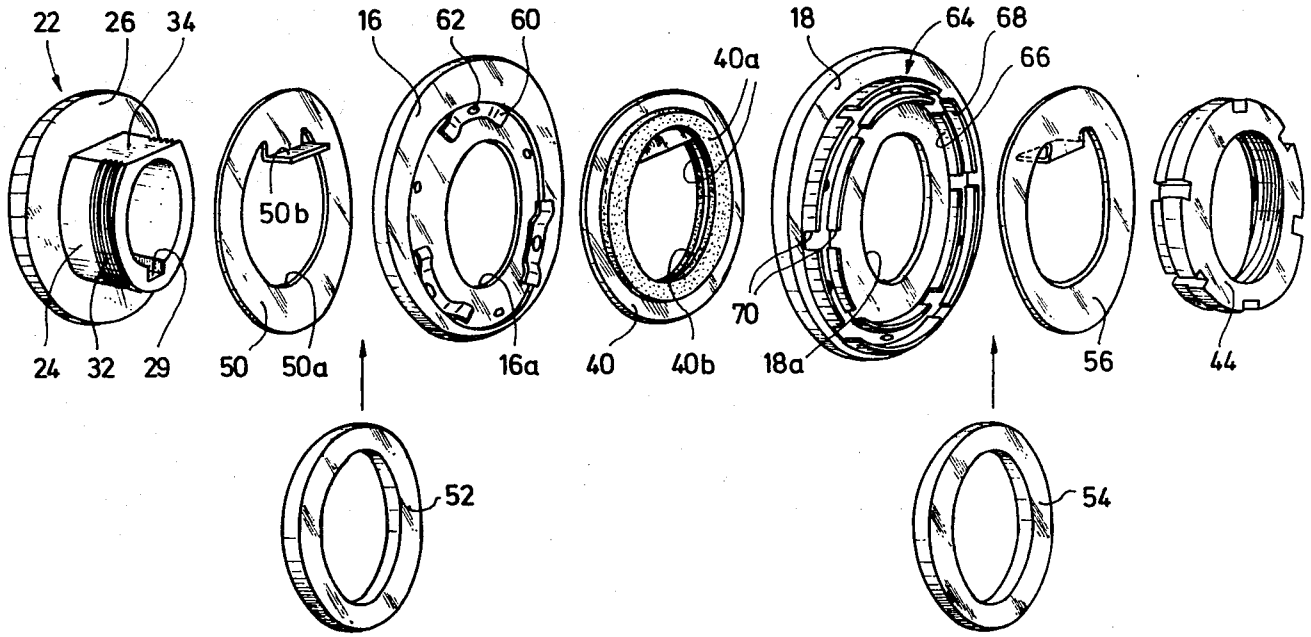
FIG. 2 is a perspective view of different components of the unit shown in the manner of an exploded drawing.

The switching mechanism according to FIGS. 1 and 2 is provided with a switch spindle 12 which is driven by the machine that is to be controlled or monitored and a plurality of disc cam stacks are serially disposed in the axial direction on said switch spindle, each such stack for controlling one electric switch, FIG. 2 showing only the disc cam stack 20. The last mentioned stack comprises a support bush 22 with a boss 24 and a flange 26 backup support and the support bush, slid upon the switch spindle 12, is prevented from rotating by positive engagement means, namely a groove 14 in the switch spindle 12, a driver key 28 and a groove 29 in the boss 24. Ring nuts, not shown but screw mounted on external screw threading of the switch spindle and having the disc cam stacks clamped between them, prevent shifting in the axial direction of disc cam stacks disposed on the switch spindle 12.

The boss 24 is provided with external screw threading 32 and furthermore the circumference of the boss is provided with a flat 34 by means of which components, slid upon the boss, can be prevented from rotating in a manner described below. A first lock washer 50, comprising of plastically deformable material according to the invention but being sufficiently stiff, is first slid upon the support bush 22 of the disc cam stack 20; advantageously, said washer is a standardized blanked-bent component produced from sheet metal with a central aperture **50*a* and a tab 50*b* projecting into said aperture and bent through 90°, adapted to bear against the flat 34 of the boss 24 thus preventing rotation of the lock washer 50 relative to the support bush 22. This is followed by a first spacer collar 52 so that according to the invention the lock washer 50 is substantially clamped and supported between the flange 26 of the support bush and the spacer collar 52**.

This is followed by two disc cams 16 and 18, adapted according to the invention to accommodate a pressure transmission collar 40 between them, both sides of which said collar are provided with friction coverings **40*a* to produce frictional engagement between the disc cams 16 and 18. This is finally followed by a second spacer collar 54 and a second lock washer 56, identical with the spacer collar 52 and the lock washer 50. All components which are slid on the support bush 22 are clamped between a ring nut 44 and the flange 26 of the boss 24 by means of the said ring nut which can be screw mounted on the external screw threading 32**.

As can be seen particularly clearly by reference to FIG. 2, the disc cams 16 and 18 have circular apertures **16*a* and 18*a* while according to the invention the pressure transmission collar 40 has a non circular aperture 40*b* corresponding to the cross section of the boss 24 so that the said collar cannot be rotated on the boss; after slackening of the ring nut 44 the disc cams 16 and 18 can therefore be rotated and adjusted in relation to the switch spindle 12 for as long as the lock washers 50** and 56 are not yet deformed. Springs 60, mounted by means of rivets 62 and adapted to retain a locking ring on each disc cam are provided on the sides of the disc cams 16, 18 nearest to the pressure transmission collar 40. According to the invention the said locking rings are provided with an inner and an outer annular web 66 or 68, projecting in the axial direction and the annular web, over which the lock washer 50 extends, is provided with at least one recess into which the lock washer can be bent. In the illustrated preferred embodiment each of the annular webs 66 and 68 is provided with a plurality of recesses 70 so that a tool can be applied approximately in the radial direction to engage in one of the recesses 70 of the outer annular web 68 so that a region of the appropriate lock washer 50 or 56, which is accessible through a casing aperture, can be bent into one of the recesses 70 of the inner annular web 66. Rotation prevention by positive means for the disc cams 16 and 18 is thus obtained since the lock washers 50 and 56 are non rotationally retained on the support bush 22 but such rotation prevention can be again released by reverse deformation of the lock washers.

In the preferred embodiment illustrated in FIGS. 1 and 2 the disc cams are therefore prevented from rotating by frictional engagement as well as by positive engagement. The purpose of the springs 60 is merely to lift the friction covers 40*a* of the pressure transmission collar 40 from inward facing surfaces of the disc cams 16 and 18 after the ring nut 44 is slackened.

Figure 3:
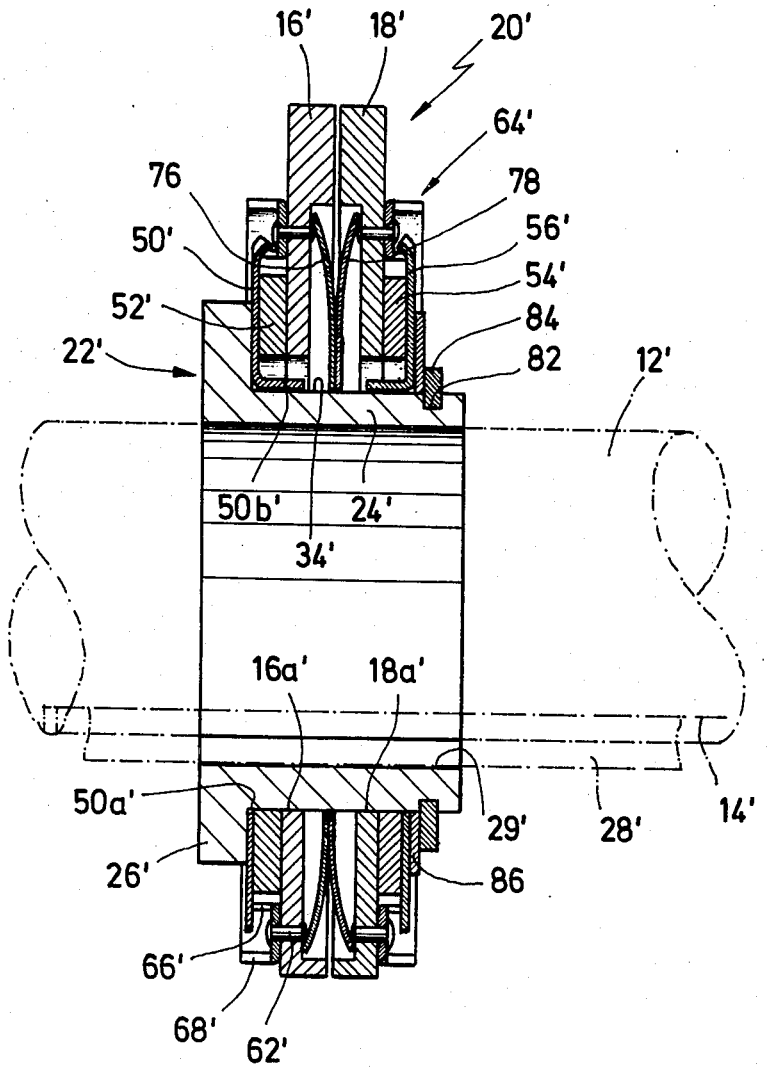
FIG. 3 is a view of the second embodiment corresponding to FIG. 1.
Figure 4:
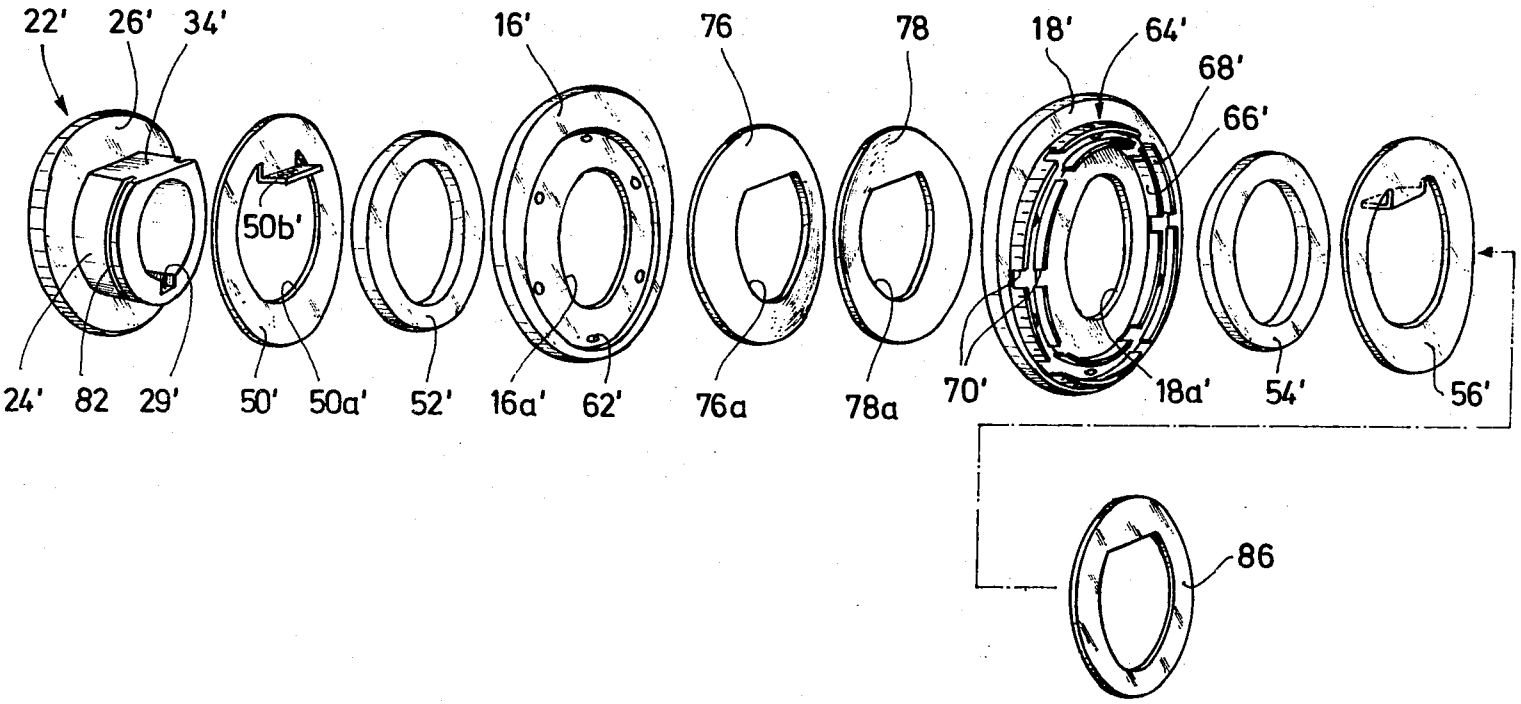
FIG. 4 is a view of the second embodiment corresponding to FIG. 2.

The embodiment according to FIGS. 3 and 4 differs from the previously described embodiment merely by virtue of dispensing with rotation prevention by frictional engagement and merely positive engagement means are used to prevent the disc cams from rotating. It is therefore also possible to dispense with a stressing element corresponding to the ring nut 44.

The same reference numerals as those used in FIGS. 1 and 2 were all also used in FIGS. 3 and 4 but with the addition of prime mark to the extent of which they referred to components whose shape and/or function correspond to components of the embodiment illustrated in FIGS. 1 and 2. Moreover, the embodiment according to FIGS. 3 and 4 will not be completely described hereinbelow but only to the extent necessary for an understanding of the difference with respect to the other embodiment.

In place of the external screw threading 32, the boss 24′ is provided with a groove 82 into which a circlip 84 or the like is inserted. An intermediate washer 86 is disposed between the lock washer 56′ and the circlip owing to the small external diameter thereof.

According to the invention only at least one spring is disposed between the disc cams 16′ and 18′ which said spring is conveniently prevented from rotating relative to the switch spindle. In the illustrated embodiment two diaphragm springs 76 and 78 with non circular apertures 76*a* and 78*a*, adapted to the cross section of the boss 24′, are disposed between the disc cams 16′ and 18′. The purpose of the said diaphragm springs is to ensure that prior to bending of the lock washers 50′ and 56′ and rotation prevention of the disc cams 16′ and 18′ effected thereby, the said disc cams can be adjusted by rotation but they do not inadvertently rotate by virtue of their dead weight (they have an eccentric centre of gravity) relative to the switch spindle 12′ or relative to the support bush 22′. Furthermore, the springs ensure that the components disposed between the flange 26′ and the circlip 84 are retained without axial clearance. Since the diaphragm springs 76 and 78 are prevented from rotating in accordance with the invention no torque can be transmitted to one disc cam when the other is rotated.

The disc cam stack 20′ according to FIGS. 3 and 4 is particularly suitable for those switching positions in a switching mechanism which are responsible for accident prevention of the controlled machine, because in such cases it it necessary for the disc cams to be correctly set only once, namely by the manufacturer of the machine, whereupon they are prevented from rotation by means of the lock washers 50′ and 56′ and by means of the recesses 70′ in the inner annular web 66′ of each disc cam.

It should also be specially mentioned, that, in accordance with the invention, the disc cam stacks 20 and 20′ according to FIGS. 1 and 2 or 3 and 4 are interchangeable, i.e. any desired number of disc cam stacks 20 and disc cam stacks 20′ can be mounted on the switch spindle of a switching mechanism.

Figure 5:
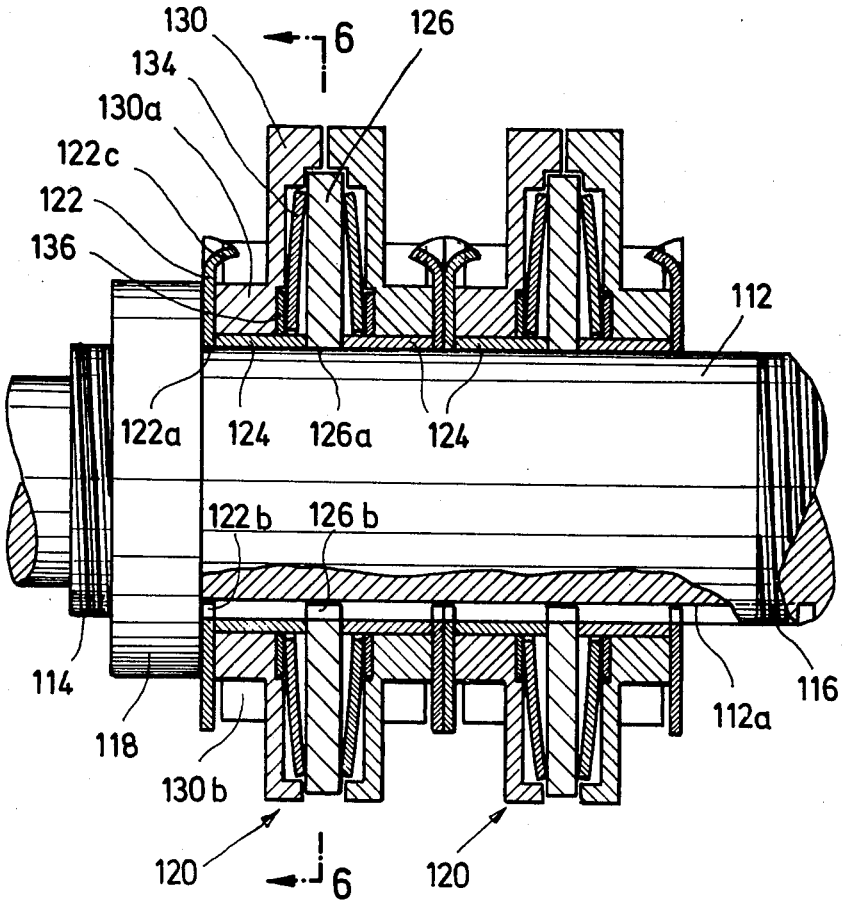
FIG. 5 shows a section through part of the switch spindle and through disc cams associated with two switching positions of the third embodiment and components adapted to secure the said disc cams.
Figure 6:
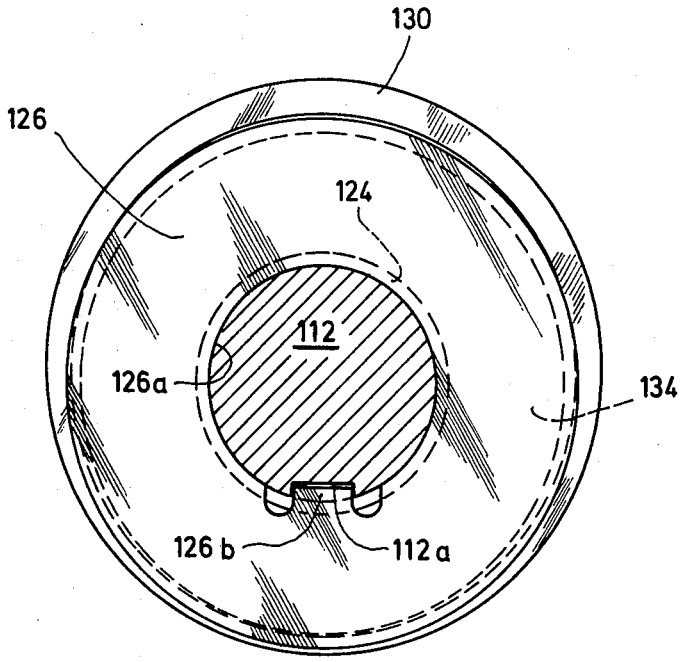
FIG. 6 is a section along the line 6—6 of FIG. 5.

Finally, FIGS. 5 and 6 show an embodiment in which according to the invention the components which are always prevented from rotation are mounted directly on the switch spindle thus obviating the support bushes shown at 22 and 22′ in FIGS. 1 to 4.

A switch spindle 112 is provided with two external screw threadings 114 and 116 on which ring nuts 118 can be screw mounted as shown on the left hand side of FIG. 5. However, a shoulder of the switch spindle, a circlip or the like can also replace a ring nut and the associated screw thread. A plurality of disc cam stacks 120 are slid upon the switch spindle so that it is sufficient to explain the construction of only one of such stacks.

According to the invention one lock washer, designated with a numeral 122 and having a central circular aperture 122*a* is also provided in this embodiment for each disc cam, and a nose 122*b* projects into the said aperture 122*a* and engages with a groove 122*a* of the switch spindle thus preventing rotation of the lock washer 122. The last mentioned lock washer is adjoined by a spacer sleeve 124 against which an intermediate washer 126 bears. The latter is also provided with a central, circular aperture 126*a* and a nose 126*b* into which a groove 112*a* engages and serves as means for preventing rotation of the intermediate washer 126. Between the intermediate washer and the lock washer there is disposed a disc cam 130 with an integrally formed boss 130*a* the circumference of which is provided with recesses 130*b* disposed at a distance from each other. One region of the adjacent lock washer 122 can be bent into one of the said recesses to produce the deformed region designated with the numeral 122*c*.

According to the invention a diaphragm spring 134 is disposed between the intermediate washer 126 and the disc cam 130 and bears on the one hand via a hard metal ring 136 on the disc cam 130 and on the other hand bears on the intermediate washer 126 to ensure that prior to deformation of the lock washer 122 the disc cam 130 does not rotate unintentionally under the effect of its own dead weight if the components disposed on the switch spindle are stressed against each other, for example if one of the ring nuts 118 is slackened or if a shoulder and circlip or the like replace one of the ring nuts.

The disc cam stacks are constructed symmetrically with respect to the middle plane of the intermediate washer 126, thus obviating the need for any further explanation of the details.

I claim:

1. A switching mechanism comprising:

(a) a rotatable switch spindle having a length dimension;

(b) means defining an unround portion on said switch spindle;

(c) at least one annular disc cam having a recess and being inserted on said switch spindle; and (d) an annular washer having an unround central aperture; said washer being mounted adjacent said disc cam on said switch spindle about said unround portion whereby relative rotation between said washer and said switch spindle is prevented; said washer being of a plastically deformable material, whereby arbitrarily selected portions of said washer are deformable in a direction generally parallel to said length dimension; said recess of said disc cam and said washer being so positioned with respect to one another that in any angular position of said disc cam on said switch spindle a portion of said washer being plastically deformable into said recess for preventing a relative rotation between said washer and said disc cam, whereby said disc cam rotates as a unit with said switch spindle for cooperating with a switch alongside the switch spindle; said disc cam being angularly adjustable with respect to said switch spindle in the absence of said portion of said washer from said recess of said disc cam.

2. The mechanism as defined in claim 1, wherein said means defines an unround portion directly on said switch spindle and further wherein the unround washer aperture fits directly on the unround spindle portion.

3. The mechanism as defined in claim 2, wherein said unround portion includes a flat part and further wherein an edge of the aperture of the washer is provided with a tab bent out of the plane of the washer and bearing against said flat part.

4. The mechanism as defined in claim 2, wherein said spindle has a longitudinally extending groove and further wherein an edge of the aperture of the washer has a tab projecting radially into said groove.

5. The mechanism of claim 1, wherein said means defining an unround portion comprises a bush having an unround outer surface and being inserted on and affixed to said switch spindle; said unround central aperture of said washer fitting onto said unround outer surface of said bush.

6. The mechanism as defined in claim 5, wherein said unround outer surface has a flat part and further wherein an edge of the aperture of the washer is provided with a tab bent out of the plane of the washer and bearing against said flat part.

7. The mechanism as defined in claim 1, further comprising a securing nut surrounding said spindle and carried thereon by a threaded connection and a backup support carried on said spindle; said nut and said backup support flanking and clamping together the assembly comprising said disc cam and said washer, whereby said disc cam is additionally prevented from rotating relative to said spindle.

8. The mechanism as defined in claim 1, further comprising means defining a circumferential groove surrounding said spindle; a circlip surrounding said spindle and received in said circumferential groove; and a backup support carried by said spindle; said circlip and said backup support flanking and holding together the assembly comprising said disc cam and said washer.

9. The mechanism as defined in claim 1, wherein said cam disc and said washer are each duplicated to provide a plurality of cam discs and a plurality of washers on said spindle; said plurality of cam discs and washers being grouped into a first assembly formed of at least two said cam discs and at least two said washers each associated with a separate said cam disc and a second assembly spaced on said spindle from said first assembly and formed of at least two said cam discs and at least two said washers each associated with a separate said cam disc; further comprising a securing nut surrounding said spindle and carried thereon by a threaded connection and a first backup support carried on said spindle; said nut and said first backup support flanking and clamping together said first assembly, whereby the disc cams of said first assembly are additionally prevented from rotating relative to said spindle; means defining a circumferential groove surrounding said spindle; a circlip surrounding said spindle and received in said circumferential groove; and a second backup support carried by said spindle; said circlip and said second backup support flanking and holding together said second assembly.

* * * * *